US006202353B1

(12) United States Patent
Giacomelli

(10) Patent No.: US 6,202,353 B1
(45) Date of Patent: Mar. 20, 2001

(54) ALUMINIUM SECTION MEMBER ASSEMBLY WITH A THERMAL BRIDGE GAP FOR WINDOW AND DOOR FRAMES

(76) Inventor: Mario Giacomelli, Via Provinciale Stacca, 1, 25050 Rodengo Saiano (IT)

( * ) Notice: Subject to any disclaimer, the term of this patent is extended or adjusted under 35 U.S.C. 154(b) by 0 days.

(21) Appl. No.: 09/380,974

(22) PCT Filed: Mar. 12, 1998

(86) PCT No.: PCT/IT98/00052

§ 371 Date: Nov. 23, 1999

§ 102(e) Date: Nov. 23, 1999

(87) PCT Pub. No.: WO98/40594

PCT Pub. Date: Sep. 17, 1998

(30) Foreign Application Priority Data

Mar. 13, 1997 (IT) ..... MI97A0571

(51) Int. Cl.[7] ..... E06B 1/04

(52) U.S. Cl. ..... 49/504; 49/DIG. 1; 52/204.1

(58) Field of Search ..... 49/DIG. 1, DIG. 2, 49/501, 504; 52/204.1, 204.5

(56) References Cited

U.S. PATENT DOCUMENTS 3,798,869 * 3/1974 Nipp ..... 52/743
4,069,631 * 1/1978 Nahr ..... 52/309.5
4,395,862 * 8/1983 Jager et al. ..... 52/731
4,815,245 * 3/1989 Gartner ..... 52/171
4,831,780 * 5/1989 Bockwinkel ..... 49/504
5,414,962 * 5/1995 Forbis et al. ..... 49/454
6,035,596 * 3/2000 Brunnhofer ..... 52/404.1

* cited by examiner

*Primary Examiner*—Daniel P. Stodola
*Assistant Examiner*—Curtis A. Cohen
(74) *Attorney, Agent, or Firm*—Hedman & Costigan, P.C.

(57) ABSTRACT

The apparatus relates to an aluminium section member assembly with thermal bridge gap for window and door frames. The subject section member assembly comprises an outer section member (10, 20) and an inner section member (11, 21), which are coupled to one another by at least two strips (12, 13, 14, 15) made of a thermally insulating synthetic material. The two strips (12, 13, 14, 15) and the section member region arranged between the two strips define and inner chamber (15). In this chamber is arranged a filling body (30) made of a thermally insulating synthetic material which prevents any convection flows from occurring in the chamber, thereby improving the thermal insulation between the outer section member (10, 20) and inner section member (11, 21).

2 Claims, 1 Drawing Sheet

ALUMINIUM SECTION MEMBER ASSEMBLY WITH A THERMAL BRIDGE GAP FOR WINDOW AND DOOR FRAMES

BACKGROUND OF THE INVENTION

The present invention relates to an aluminium section member assembly with a thermal bridge gap for window and door frames.

Prior aluminium section members, including a thermal bridge gap, for making window and door frames conventionally comprise an outer section member made of extruded aluminium and an inner section member also made of extruded aluminium, which are rigidly coupled to one another by coupling strips or small bars made of a thermally insulating synthetic material, usually a polyamide material. These prior strips operate to provide a mechanical coupling between the two extruded aluminium section members, while interrupting the thermal conductibility between the two metal section members.

The coupling between the outer section member and inner section member, provided by using the above two strips, generates, between the two metal section members, a chamber defined by said two strips and by that region of the two metal section members which is arranged between said strips.

Inside the mentioned chamber convective hot and cold air flows can be generated, depending on the time or seasons, which practically provide a thermal transmission between the two metal section members.

The above mentioned thermal transmission, even if is comparatively small, causes a some amount of heat to flow between the outer metal section member and inner metal section member.

In order to solve this problem, a prior method provides to fill-in into said inner chamber, as the outer section member and inner section member are coupled, a thermally insulating material, of any desired suitable natures, such as, for example, polyurethane foamed materials, cast resin materials, plastic material films and the like.

This method allows to eliminate, or reduce, the thermal transmission between the metal section members: however, it requires specifically designed section members, which must be provided with different characteristics, both from a technical standpoint and from an economical standpoint and actually, prior section members for solving the above mentioned problems have been found to be greatly expensive, since they require comparatively long making steps.

SUMMARY OF THE INVENTION

Accordingly, the aim of the present invention is to solve the above mentioned problem, by providing an aluminium section member assembly, with a thermal bridge gap, which is specifically designed for window and door frames, in which is fully eliminated a possible thermal transmission between the metal outer section member and inner metal section member, due to convective motions in the inner chamber, without requiring complex constructional operations or modifications of a conventional section member making line of the type conventionally used for making thermal bridge gap section members.

Within the scope of the above mentioned aim, a main object of the present invention is to provide such a section member assembly allowing to greatly improve the thermal insulation of the component section members thereof, without the need of specifically designing special section members and without any increase of the making cost.

Another object of the present invention is to provide such a section member assembly which, owing to its constructional features, is very reliable and safe in operation.

Yet another object of the present invention is to provide such an aluminium section member assembly, with a thermal bridge gap, which can be easily made starting from easily available elements and materials and which, moreover, is very competitive from a mere economic standpoint.

According to one aspect of the present invention, the above mentioned aim and objects, as well as yet other objects, which will become more apparent hereinafter, are achieved by an aluminium section member assembly, with a thermal bridge gap, specifically designed for window and door frames and the like, comprising an outer section member and an inner section member which can be coupled to one another by at least two strips made of a thermally insulating synthetic material.

The mentioned two strips and that region of the section members arranged between said two strips define an inner chamber, characterized in that in said chamber a filling body made of a thermally insulating synthetic material is arranged.

BRIEF DESCRIPTION OF THE DRAWINGS

Further characteristics and advantages of the section member assembly according to the present invention will become more apparent hereinafter from the following detailed disclosure of a preferred, though not exclusive, embodiment of said section member assembly which is illustrated, by way of a merely indicative, but not limitative, example, in the figures of the accompanying drawings, where.

DESCRIPTION OF THE PREFERRED EMBODIMENT

Figure 1:
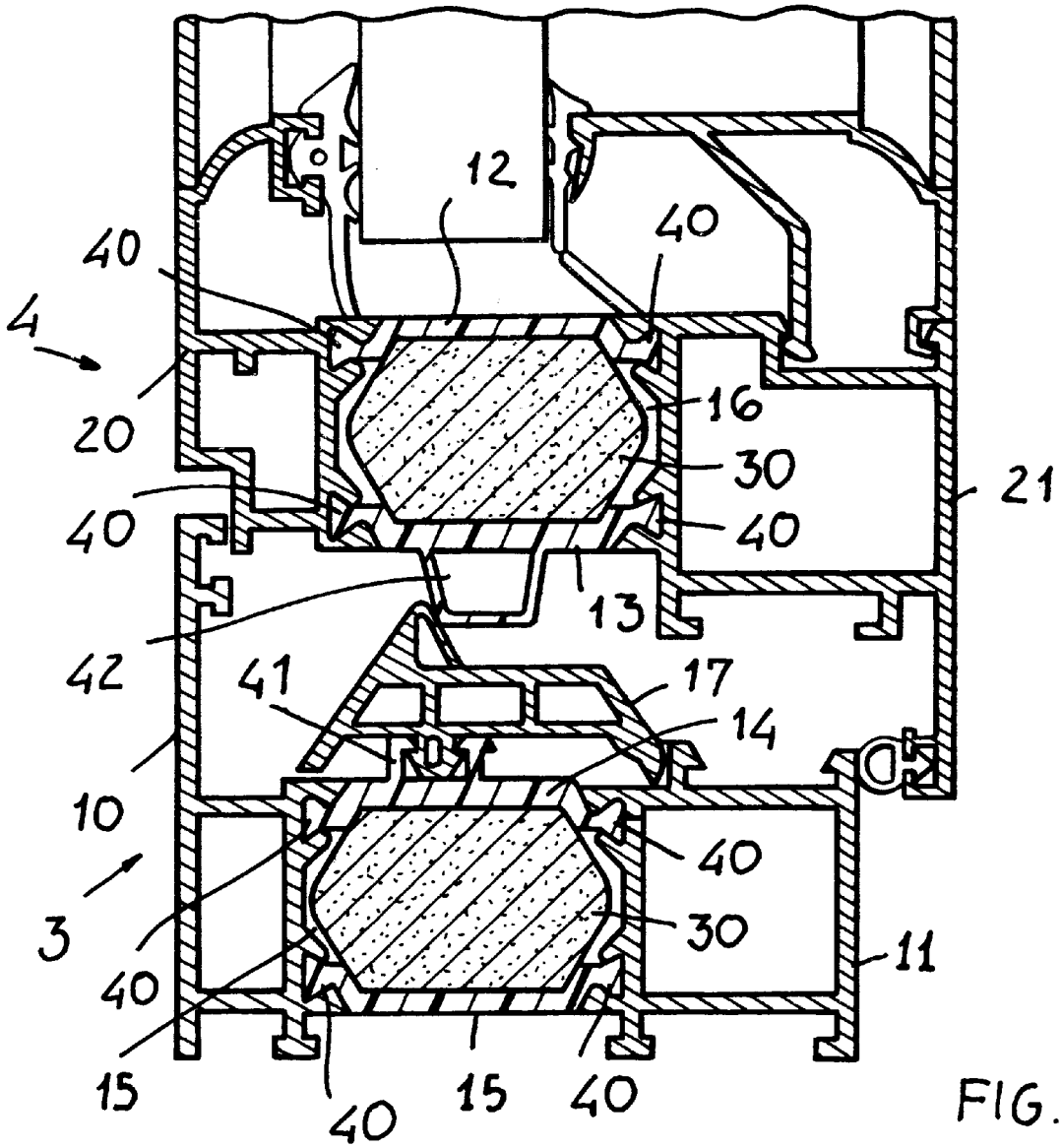
FIG. 1 is a cross-sectional view illustrating the coupling region between the movable portion and fixed portion of a window or door frame made of a section member assembly according to the present invention.
Figure 2:
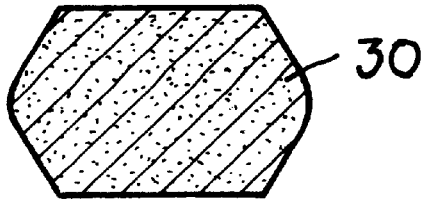
FIG. 2 is a further cross sectional view illustrating the filling body provided for filling the inner chamber.

With reference to the number references of the above mentioned figures, the aluminium section member assembly, with a thermal bridge gap, according to the present invention, comprises an outer section member 10, 20 and an inner section member 11, 21 which are coupled to one another by a pair of strips or small bars 12, 13 and 14, 15 made of a thermally insulating synthetic material, preferably polyamide.

The strips 12, 13 and 14, 15 are coupled, at the contoured side end portions thereof, inside suitable axial slots 40 defined, during the extruding operation, inside the metal section members 10, 20, 11 and 21.

Said pairs of strips 12, 13 and 14, 15 are spaced from one another, so that between the pairs of strips and that region of the metal section members arranged between said pairs of strips, an inner chamber 15 is defined.

Inside said chamber, according to the present invention, a filling body 30, comprising a thermally insulating synthetic material, is filled-in.

More specifically, the filling body 30 is also preferably constituted by an extruded section member of a thermally insulating material, preferably of the foamed closed cell polyethylene type.

The configuration of the filling body 30 is as near as possible similar to that of the inner chamber 16, thereby allowing said filling body 30 to nearly fully filling said chamber 16 upon engagement therein.

In particular, the filling body 30 is made separately from the metal section members and is engaged inside said chamber 16 after having assembled the outer section members 10 and 20 to the inner section members 11 and 21 by the above mentioned strips or small bars 12, 13 and 14, 15.

Thus, the section members of the subject section member assembly can be made by using conventional aluminium section member making lines, specifically designed for producing thermal bridge gap aluminium section members.

The filling of the inner chamber 16, performed by introducing into said chamber the filling body 30, will prevent any convective flow from occurring inside said chamber 16 thereby greatly improving the thermal insulation between the inner section member and outer section member.

FIG. 1 illustrates a coupling region between the fixed portion, generally indicated by the reference number 3, of a window or door frame, and the movable portion thereof, generally indicated by the reference number 4.

As shown, the fixed portion 3 comprises the outer section member 10 and inner section member 11, which are coupled to one another by a strip or small bar 14 and a further strip or small bar 15. The strip 14 can be provided, in a per se known manner, on the outer side thereof, with a U-shape extension 41, allowing a three-tubular resilient gasket 17 to be pressure engaged therein.

The movable portion 4, on the other hand, also comprises an outer section member 20 and an inner section member 21, which are coupled to one another by a strip 12 and a further strip 13.

The strip 13 is provided, on the outer side thereof, with a tubular lug 42, having a trapezoidal cross-section, defining an abutment for the three-tubular resilient gasket 17.

From the above disclosure and the observation of the figures of the accompanying drawings, it should be apparent that the invention fully achieves the intended aim and objects.

In particular, the fact is to be pointed out that an aluminium section member assembly, with a thermally bridge gap, specifically designed for window and door frames and the like, has been provided, which allows to obtain a very efficient thermal insulation between the metal outer section member and metal inner section member, while using construction-wise simple section members and without requiring specifically designed making lines.

While the subject section member assembly has been disclosed and illustrated with reference to a preferred embodiment thereof, it should be apparent that the disclosed assembly is susceptible to several modifications and variations coming within the scope of the accompanying claims.

In practicing the invention, the used materials, provided that they are compatible to the intended application, as well as the contingent size and shapes, can be any, depending on requirements.

What is claimed is:

1. An aluminum section member assembly with a thermal bridge gap, said aluminum section member assembly comprising first and second frame members, each frame member including an outer section member and an inner section member, said inner section member coupled to said outer section member by at least two strips made of a thermally insulating synthetic material and defining, with portions of said outer section member and said inner section member, an inner chamber into which is inserted a thermally insulating material filling body; wherein said thermally insulating synthetic material filling body comprises an extruded section member made of a closed cell foamed plastic material, said filling body being extruded separately from said section members with a configuration substantially like the configuration of said inner chamber, said configuration being adapted to be fitted into said inner chamber after said outer section member and said inner section member have been assembled together to form said section member assembly, and wherein at least one of said strips is provided, on an outer side of said first frame member thereof, with a tubular lug of trapezoidal closed cross section, defining an abutment surface, at least another of said strips being provided, on an outer side of said second frame member thereof, with a U-shaped extension that pressure engages another portion of a three-tube resilient gasket.

2. A section member assembly, according to claim 1, wherein said filling body is made of a closed cell foamed polyethylene.

* * * * *